US006673467B2

(12) United States Patent
Scarlin et al.

(10) Patent No.: US 6,673,467 B2
(45) Date of Patent: Jan. 6, 2004

(54) METALLIC COMPONENT WITH PROTECTIVE COATING

(75) Inventors: Richard Brendon Scarlin, Oberflachs (CH); Reinhard Knödler, Sandhausen (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/965,793

(22) Filed: Oct. 1, 2001

(65) Prior Publication Data

US 2003/0064244 A1 Apr. 3, 2003

(51) Int. Cl.[7] ..... B32B 15/01; B05D 3/00

(52) U.S. Cl. ..... 428/615; 148/527; 427/383.7; 427/446; 428/610; 428/636; 428/637; 428/650; 428/652; 428/656; 428/666; 428/667; 428/668; 428/678; 428/679; 428/680; 428/681; 428/685; 428/686; 428/925; 428/926; 428/935; 428/936; 428/937

(58) Field of Search ..... 428/615, 610, 428/636, 637, 650, 652, 656, 666, 667, 668, 678, 679, 680, 681, 685, 686, 925, 926, 935, 936, 937; 148/527; 427/446, 383.7

(56) References Cited

U.S. PATENT DOCUMENTS

| | | | | |
|---|---|---|---|---|
| 3,849,865 A | | 11/1974 | Gedwill et al. | |
| 3,869,779 A | | 3/1975 | Gedwill et al. | |
| 4,198,442 A | * | 4/1980 | Gupta et al. | 428/678 |
| 4,371,570 A | | 2/1983 | Goebel et al. | |
| 5,595,831 A | | 1/1997 | Clark | |
| 6,226,978 B1 | | 5/2001 | Chandra et al. | |

FOREIGN PATENT DOCUMENTS

| | | |
|---|---|---|
| DE | 19728054 A1 | 1/1999 |
| EP | 0 186 266 | 7/1986 |
| EP | 1122329 A1 | 8/2001 |
| JP | 3-79751 | 4/1991 |
| JP | 7-173635 | 7/1995 |
| WO | WO96/34130 | 10/1996 |
| WO | WO0070190 | 11/2000 |

OTHER PUBLICATIONS

"*Materials for Advanced Power Engineering 1994, Part I*", Proceedings of a Conference held in Liége, Belgium, Oct. 3–6, 1994, edited by D. Coutsouradis et al., Kluwer Academic Publishers, The Netherlands, pp. 728–729.

* cited by examiner

*Primary Examiner*—Robert R. Koehler
(74) *Attorney, Agent, or Firm*—Burns, Doane, Swecker & Mathis, L.L.P.

(57) ABSTRACT

A metallic component exposed to high temperature steam is provided with a coating comprising a thin primer layer deposited on the surface of the metallic component and a thicker overlay layer on top of the primer layer. The primer layer consists of highly ductile, oxidation resistant material such that it remains free of any defects over a long period of exposure. The overlay layer consists of an oxidation resistant, less ductile, and low-cost material. It protects the thin primer layer from mechanical damage and chemical degradation. The primer layer protects the base material of the metallic component from oxidizing steam that may penetrate through cracks of the overlay layer. Due to suitable choice of coating materials and thicknesses of the layers the coating is low-cost.

18 Claims, 1 Drawing Sheet

METALLIC COMPONENT WITH PROTECTIVE COATING

FIELD OF THE INVENTION

The invention pertains to metallic components with a coating that is resistant to high temperature steam oxidation and/or corrosion and to a method of applying the coating to the metallic component.

BACKGROUND OF THE INVENTION

It is well known that metallic components exposed to high temperature steam can oxidize and/or corrode and sustain damage when surface oxide layers spall off. Such damage due to high temperature steam oxidation is observed for example on components in steam power plants. These components are exposed to steam of temperatures higher than 550° C. as such steam temperatures are necessary to increase the power plant efficiency.

Oxide layers on components of steam power plants can cause various problems. For example, on heated components such as boiler tubes the growth of oxide layers reduces the thermal conductivity from the outside or fireside to the inside or steam side of the tube walls. This results in an increase of the wall temperature, which in turn can cause creep failure under the internal pressure loading. From heated as well as not heated components exposed to high temperature steam the oxide layers can spall off, which can result in the formation of hard oxide particles. Such particles can cause erosion on other parts of the power plant such as boiler parts, turbine blades and vanes, the rotor, piping, or housing components. They can also impair the function of devices, for example by blocking valve components. As a result, the lifetime of the components is severely reduced.

Steels with a modified composition, for example with additional chromium or cobalt, show a greater oxidation resistance and greatly improve component durability and lifetime. However, the advantage of good oxidation resistance is countered by high cost and, in the case of chromium addition, by a reduction in creep strength, which is necessary in high temperature applications.

The oxidation resistance of components is also improved by the application of protective coatings. The components may be manufactured using relatively low cost materials and coated with very thin layers at only a modest cost. Various coatings are known for the application to components of steam power plants.

U.S. Pat. No. 5,595,831 discloses turbine components plated with nickel metal and coated with a protective layer against corrosion consisting essentially of nickel and zinc. In order to prevent the zinc from diffusing into the component material the component surface is plated with a nickel metal prior to the application of the nickel/zinc coating.

DE 19728054 discloses a tube used for example for the superheating of steam in a boiler of a steam power plant. The tube comprises on its inner surface a coating consisting of a nickel-phosphorus alloy. The coating provides a high oxidation and temperature resistance.

WO 00/70190 discloses a metallic component comprising a coating essentially consisting of aluminum and applied to the component surface by diffusion. The coating provides a resistance to high temperature steam oxidation.

Tests have shown that coatings of these types described above generally suffer from cracking either during application or during exposure of the component to high temperature steam. The cracking eventually allows steam to reach through the coating to the component surface and for oxidation to occur. Even in the case when the coating material is diffused into the substrate material cracks have been observed beyond the diffusion depth and to cause oxidation in the component base material.

SUMMARY OF THE INVENTION

In view of the problems disclosed in connection with the development of metallic components resistant to high temperature steam oxidation it is the object of the invention to provide a metallic component that is resistant to high temperature steam oxidation over a long period of time. In particular, the metallic component shall not develop cracks as observed in components of the state of the art that allow oxidation to occur of the base material of the component after a certain time of exposure. The component shall furthermore be resistant to mechanical loading as for example by impingement of hard solid particles resulting from oxidation and spalling of oxide particles. Furthermore, the metallic component shall have the aforementioned characteristics even when it has a complex shape. Finally, the component shall be relatively low in cost compared to the disclosed components of the state of the art.

It is a further object of the invention to provide a method to manufacture and apply the coating to the surface of the metallic component.

A metallic component exposed to high temperature steam is equipped with a coating that protects the surface of the metallic component from oxidation and/or corrosion. According to the invention the coating on the surface of the metallic component comprises one or more thin, oxidation resistant primer layers that have a high ductility and are free of cracks and pores. Furthermore, the coating comprises one or more oxidation resistant and lower ductility overlay layers deposited on top of the one or more primer layers that protect the primer layers from mechanical damage and have greater thickness than the primer layers.

The one or more primer layers deposited immediately on the surface of the base material of the metallic component consist of an oxidation resistant material and are highly ductile. The high ductility of the material yields a layer that is dense and remains free of any defects such as cracks, pores, or cavities over a long period of exposure to high temperature steam. The crack-free primer layer allows no oxidizing steam to reach the base material of the component and hence provides a very high oxidation resistance.

Such crack-free materials are typically very costly; hence the primer layer is deposited as a thin layer so as to minimize the amount of material necessary. However, a thin layer is more prone to mechanical damage such as from particle impingement than is a thick layer. For this reason an oxidation resistant overlay layer of greater thickness is applied on top of the primer layer in order to provide mechanical protection. As the greater thickness of the overlay layer requires more material a less costly material is chosen for it so that the overall component cost remains low. Low cost material layers tend to be more brittle and form cracks after a certain time of exposure to high temperature steam. Such cracks allow oxidizing steam to penetrate through the overlay layer. However, the crack-free primer layer prevents it from reaching the surface of the base material of the component as the primer layer mainly provides the oxidation resistance.

The combination of primer layer and overlay layer according to the invention provides the necessary oxidation resistance over a long exposure time as well as resistance to mechanical damage. Furthermore, the choice of materials and their thicknesses yields a relatively low-cost protective coating.

In a first embodiment of the invention the one or more primer layers comprise a superalloy such as for example a nickel or cobalt based alloy or a stellite alloy.

In a preferred embodiment the superalloy consists of MCrAlY where the M signifies a metal such as Ni, Co, or Fe.

In a further embodiment of the invention the primer layer is applied in a layer with a thickness equal to or less than 30 microns.

In a preferred embodiment of the invention the thickness of the primer layer is approximately 5 microns.

In a further embodiment of the invention the overlay layer comprises a Ni—P alloy, an Al or Al—Si alloy, or Cr alloy.

These are low-cost materials known for their oxidation resistance. They are easily applied in larger thicknesses. However, due to their brittle characteristic they form cracks that can reach through the entire layer down to the surface of the primer layer.

In a particular embodiment of the invention the thickness of the overlay layer is in the range from 30 to 100 microns. This thickness assures the protection of the primer layer from mechanical damage as well as from chemical degradation.

In a preferred embodiment of the invention the overlay has a thickness in the range from 30 to 70 microns.

A method to apply the protective coating on a metallic component as described above comprises the following steps.

Application of the primer layer by means of a thermal spraying process and application of the overlay layer by means of spraying or painting of an aqueous solution or the immersion or the exposure to an aqueous electrolyte.

The thermal spraying process is for example a high velocity oxygen flame process, and the immersion or exposure to an aqueous electrolyte can be performed with or without the application of an electrical potential.

This method allows the application of the coating layers on components of a complex shape without an increase of effort and manufacturing cost.

In a further method according to the invention following the application of the primer and overlay layers the coating layers are subjected to a thermal treatment. This allows for an interdiffusion between the elements of the layers whereby the adhesion between the layers and to the base material of the metallic component is increased. A spalling of the layers during exposure to high temperature steam is largely prevented by this measure.

BRIEF DESCRIPTION OF THE DRAWINGS

The only

DETAILED DESCRIPTION OF THE INVENTION

Figure 1:
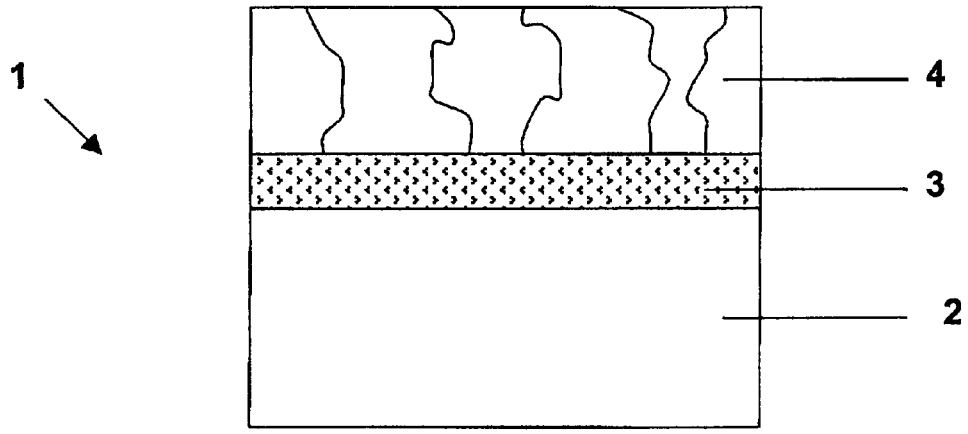
FIG. 1 shows a cross-section through the surface portion of a metallic component with a protective coating according to the invention.

The metallic component can be any component exposed to high temperature steam such as a heat exchange tube in a boiler of a steam power plant, a turbine blade, a part of a turbine casing or rotor, a part of piping for high temperature steam and so forth. The metallic component 1 comprises a base material 2 and a protective coating having two layers. The base material consists of a ferritic, martensitic or ferritic-martensitic steel with a suitable creep strength for the application, as for example a low alloyed steel with 1% Cr or a high alloyed steel with 13% Cr. In this example, this base material consists of a 9% Cr steel. The coating has a first layer or primer layer 3 comprising a nickel-based alloy such as NiCrAlY. This layer has for example a thickness of 5 microns. NiCrAlY is known for its high oxidation resistance in a high temperature steam environment due to its high Cr and Al content. The yttrium content ensures a good adhesion to the base material. Most importantly the alloy has a high ductility and as such a very high resistance to cracking in a high temperature steam environment over a long period of time. The NiCrAlY is a costly material. In order to keep the coating low-cost the thickness of the NiCrAlY layer is chosen relatively small, ranging between 5 and 30 microns. This reduces the cost of the layer. However, the thin primer layer is prone to mechanical damage and chemical degradation. Due to its small thickness it would be easily damaged by particles impinging on it. For this reason the coating comprises a second or overlay layer 4. The overlay layer comprises Ni—P with a phosphorus content of about 12%. This layer is significantly thicker compared to the primer layer 3 having a thickness in the range of 30 to 100 microns. It protects the primer layer from chemical degradation and mechanical damage due to impinging particles. Ni—P alloys with a sufficiently high P-content of 12% provide a good oxidation resistance. Either during the application process or after a certain time of exposure to high temperature steam they tend to develop microcracks. However, for the multiple layer coating according to the invention such microcracks are of no consequence to the overall oxidation resistance of the component. As the overlay layer provides the mechanical protection as well as some oxidation resistance, the primer layer provides the high, long-term oxidation resistance, as it does not develop any cracks either during application or as a result of exposure to high temperature steam.

The primer layer of the coating is applied by means of a thermal spraying process as for example a high velocity oxygen flame process (HVOF). This process is particularly suitable for producing a dense, defect free layer in a short period of time with a high level of bonding to the substrate. It also has the advantage that spraying can be performed in the normal atmospheric environment. The alternative process of plasma spraying may be performed in air or in a vacuum chamber. However, in the latter case the size of the components, which can be placed in the chamber is limited.

The overlay layer is then applied using an electroless procedure such as spraying of or immersion into an aqueous solution containing the Ni—P. This process is not only a low-cost method but is also suitable for various shapes of components including very complex shapes.

The metallic component with the protective coating can be further subjected to a heat treatment performed at temperatures in the range from 650 to 750° C. This promotes the interdiffusion of the elements of the individual layers. It also improves the adhesion between the individual coating layers as well as between the coating and the base material of the component.

A second example of a metallic component according to the invention comprises a base material consisting of 2.25% Cr steel. On the surface of the component a primer layer is applied comprising a stelifte alloy or a hard surfacing material such as WC—Co. Similar to the primer layer in the first example this primer layer is applied by a thermal spraying or plasma spraying process and to a thickness of about 5 microns. The stellite alloy provides a very high oxidation resistance and resists the formation of microcracks when exposed to high temperature steam. Due to the high cost of the material it is applied only with a small thickness. The thin primer layer is then coated by a thicker overlay layer comprising an aluminium or aluminium-silicon alloy. This overlay layer provides again protection against mechanical damage due to impingement by particles as well as against chemical degradation. Like the Ni—P, it also tends to develop cracks that allow oxidizing steam to reach as far as the primer layer. However, a high oxidation resistance is provided by the WC—Co primer. It is resistant to microcracking and ensures that the component remains intact even in the event of a cracked overlay layer.

The stellite alloy primer layer is suitably applied by means of thermal spraying, e.g. HVOF spray) or plasma spraying process. The Al— or Al—Si overlay layer is applied preferably by painting a slurry or spraying an aqueous solution containing particles containing Al along with other elements such as Si or Cr. The coating thickness is preferred to be 30 to 100 microns. In general terms the protection from oxidation increases with the thickness of the coating.

A thermal treatment at 650 to 750° C. further increases the adhesion strength of the stellite alloy and WC—Co layers.

Further examples of metallic components with protective coatings according to the invention comprise more than one primer layer or more than one overlay layer of the above mentioned materials. These may further improve the protective characteristics of the coating.

What is claimed is:

1. A metallic component exposed to high temperature steam with a coating that protects the surface of the metallic component from oxidation and/or corrosion is claimed wherein the coating on the surface of the metallic component comprises one or more thin, oxidation resistant primer layers having a high ductility and being free of defects, and the coating comprises furthermore one or more lower ductility, oxidation resistant overlay layers deposited on top of the one or more primer layers and having overall a greater thickness than the primer layers, and wherein the overlay layer comprises a Ni—P alloy, an Al or Al—Si alloy, or a Cr alloy.

2. A metallic component according to claim 1 wherein the one or more primer layers each comprise a superalloy.

3. A metallic component according to claim 2 wherein the superalloy is a nickel or cobalt based alloy, a stellite alloy, or consists of MCrAlY where M signifies Ni, Co, Fe, or a combination of Ni and Co.

4. A metallic component according to claim 2 wherein the primer layer has a thickness equal to or less than 30 microns.

5. A metallic component according to claim 2 wherein the primer layer has a thickness approximately equal to 5 microns.

6. A metallic component according to claim 1 wherein the thickness of the overlay layer is in the range from 30 to 100 microns.

7. A metallic component according to claim 1 wherein the overlay layer has a thickness in the range from 30 to 70 microns.

8. A metallic component according to claim 1 wherein the base material of the metallic component is a ferritic, martensitic, or ferritic-martensitic steel.

9. A metallic component according to claim 1 wherein the metallic component is a component in a steam power plant.

10. A method to manufacture a metallic component according to claim 1 wherein the one or more primer layers are applied to the surface of the base material of the metallic component by means of a thermal or plasma spraying process and the one or more overlay layers are applied on top of the one or more primer layers by means of spraying or painting of an aqueous solution or the immersion or the exposure to an aqueous electrolyte.

11. A method according to claim 10 wherein the immersion or exposure to an aqueous electrolyte is performed with or without the application of an electrical potential.

12. A method according to claim 10 wherein the thermal spraying process is a high velocity oxygen flame spray or plasma spray process.

13. A method according to claim 10 wherein following the application of the one or more primer and one or more overlay layers the metallic component is subjected to a thermal treatment allowing an interdiffusion between the elements of the overlay and primer layers and between those in the primer layers and the base material of the metallic component.

14. A method according to claim 13 wherein the thermal treatment is performed at a temperature in the range from 650 to 750° C.

15. A metallic component exposed to high temperature steam, the metallic component comprising:

a base material of the metallic component having a composition including a ferritic, martensitic, or ferritic-martensitic steel; and a coating on a surface of the base material, wherein the coating comprises one or more thin, oxidation resistant primer layers having a high ductility and being free of defects, and one or more lower ductility, oxidation resistant overlay layers deposited on top of the one or more primer layers and having overall a greater thickness than the primer layers.

16. A metallic component exposed to high temperature steam with a coating that protects a surface of the metallic component from oxidation and/or corrosion, wherein the coating on the surface of the metallic component comprises one or more thin, oxidation resistant primer layers having a high ductility and being free of defects, and the coating comprises one or more lower ductility, oxidation resistant overlay layers deposited on top of the one or more primer layers and having overall a greater thickness than the primer layers, and wherein the overlay layer comprises a Ni—P-based alloy, an Al-based or Al—Si-based alloy, or a Cr-based alloy.

17. A metallic component according to claim 16 wherein the overlay layer comprises the Ni—P-based alloy, the Ni—P-based alloy having a phosphorous content of about 12%.

18. A metallic component according to claim 16 wherein the coating protects the surface from at least one of oxidation and corrosion.

* * * * *